United States Patent [19]

Scholz et al.

[11] 4,225,909

[45] Sep. 30, 1980

[54] LIGHTING FIXTURE

[75] Inventors: Charles F. Scholz, Cincinnati, Ohio; Robert Reibling, Fort Thomas, Ky.

[73] Assignee: Whiteway Manufacturing Co., Cincinnati, Ohio

[21] Appl. No.: 968,932

[22] Filed: Dec. 13, 1978

[51] Int. Cl.[2] ..... F21L 7/00; F21S 1/06; F21S 1/10; F21S 1/12

[52] U.S. Cl. ..... 362/367; 362/368; 362/414; 362/431

[58] Field of Search ..... 362/145, 249, 285, 367, 362/368, 396, 414, 431, 812

[56] References Cited

U.S. PATENT DOCUMENTS

| | | | |
|---|---|---|---|
| 1,777,734 | 10/1930 | Reynolds | 362/431 |
| 2,456,179 | 12/1948 | Finer | 362/431 |
| 3,218,446 | 11/1965 | Langer | 362/431 |

*Primary Examiner*—Donald P. Walsh

*Attorney, Agent, or Firm*—Seidel, Gonda, Goldhammer & Panitch

[57] ABSTRACT

The lighting fixture is adapted to be secured to the outer periphery of a generally vertically disposed column. The fixture is comprised of at least two housing sections which are coupled together with each housing section having a recess on its inner periphery for embracing a portion of the vertically disposed column. Each housing section has a source of illumination for projecting light upwardly through a transparent portion of the top wall of each housing section.

14 Claims, 7 Drawing Figures

FIG. 1
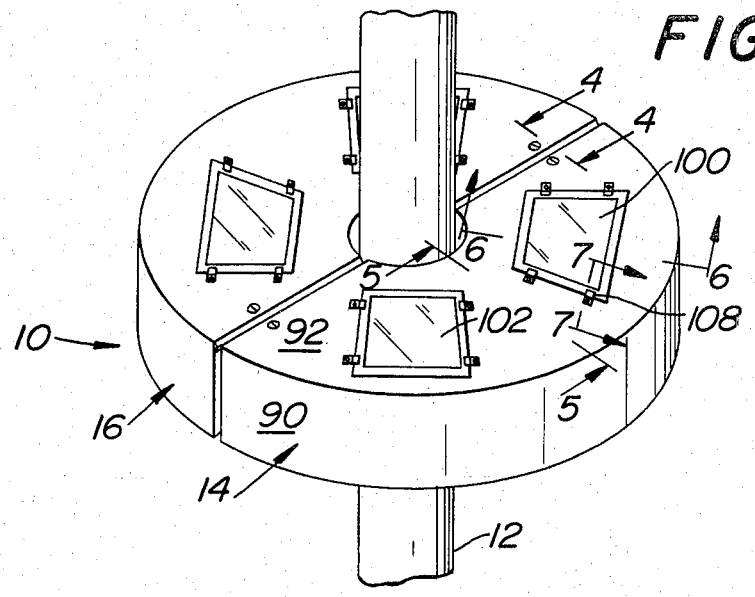
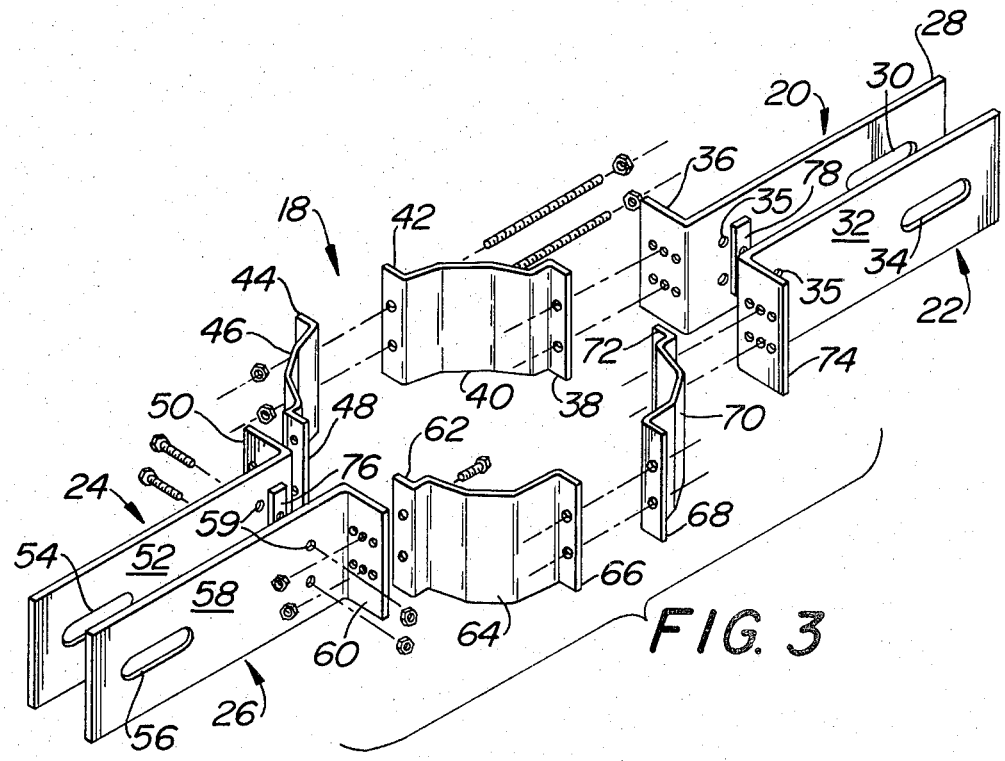
FIG. 3

FIG. 2
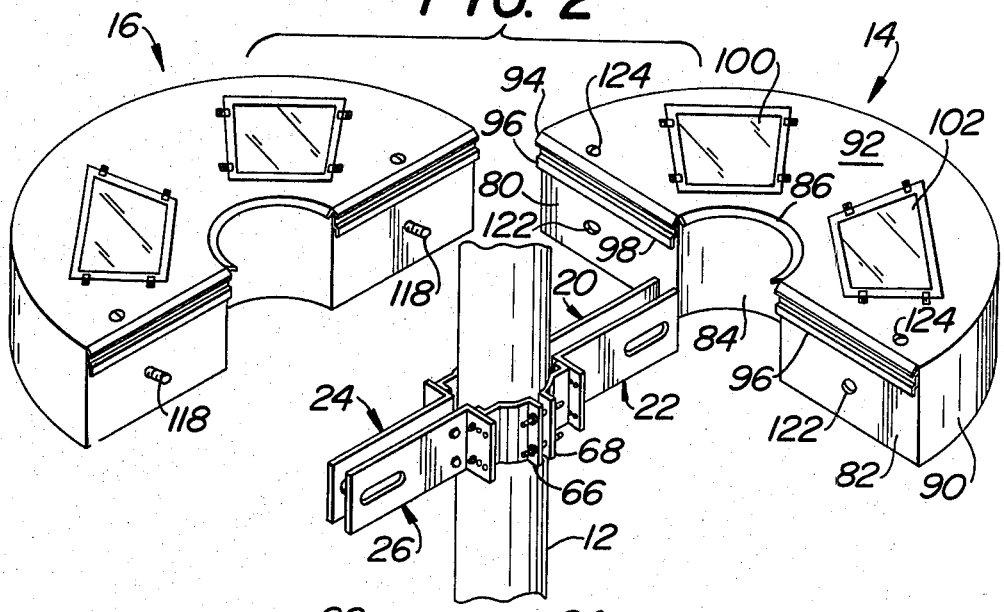
FIG. 4
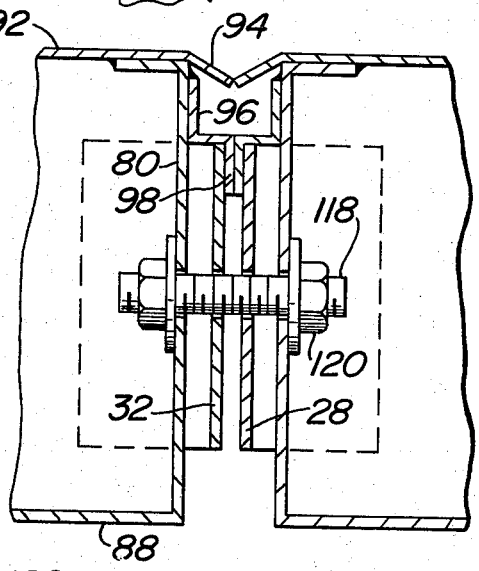
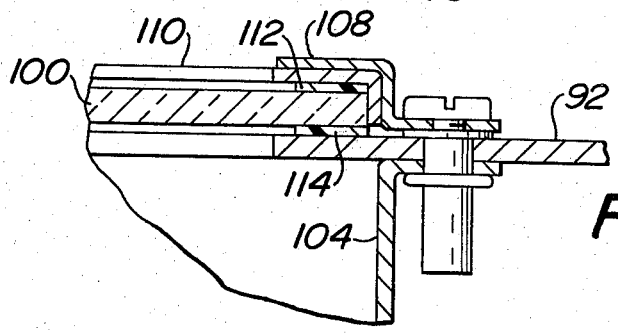
FIG. 7

LIGHTING FIXTURE

BACKGROUND

It is known to attach a lighting fixture to a generally vertically disposed column at a location intermediate the ends of the column. See U.S. Pat. Nos. 2,456,179 and 3,777,138. In U.S. Pat. No. 2,456,179, the fixture is attached to the column by means of a limit stop ring welded to the outer periphery of the column. Attachment of a fixture to a column in that manner is frequently impractical, too expense or undesirable. In U.S. Pat. No. 3,777,138, the fixture is attached to the column by way of a set screw which inherently limits the weight and type of fixture which can be attached in that manner.

There is a need for a lighting fixture which is readily attachable to the outer periphery of new or existing vertical columns, with the fixture being arranged to direct illumination generally upwardly.

SUMMARY OF THE INVENTION

The present invention is directed to a lighting fixture adapted to be secured to a generally vertically disposed column. The fixture includes a housing divided into at least two sections. Each housing section has an inner periphery and an outer periphery. The inner periphery on each housing section has a recess for receiving therein a portion of the periphery of the generally vertically disposed column. Each housing section has therewithin at least one source of illumination. The top wall of each housing section is provided with a transparent portion through which illumination may project generally upwardly from its associated light source. Each of said transparent portions is removably supported to facilitate relamping its associated light source.

A coupling means joins each of the housing sections together preferably at juxtaposed walls which are disposed between the inner and outer peripheries of said housing sections. A means is provided for securing said sections to a generally vertically disposed column in a manner so that the inner periphery of the housing sections embraces the outer periphery of a column. A means is provided for defining a wireway between the housing sections.

It is an object of the present invention to provide a novel lighting fixture adapted to be secured to a generally vertically disposed column.

It is another object of the present invention to provide a novel lighting fixture comprised of several sections and structurally interrelated in a manner so that it may be removably attached to a generally vertically disposed column in a manner which is simple, inexpensive and reliable.

It is another object of the present invention to provide a novel lighting fixture for attachment to a vertically disposed column and for projecting light upwardly toward a canopy supported by the column.

It is another object of the present invention to provide a novel lighting fixture which is easy and inexpensive to install and maintain.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a generally vertically disposed column with the lighting fixture of the present invention attached thereto.

FIG. 2 is an exploded view of the fixture in column shown in FIG. 1.

FIG. 3 is an exploded view of a mounting bracket.

FIG. 4 is a sectional view taken along the line 4—4 in FIG. 1.

FIG. 7 is a sectional view taken along the line 7—7 in FIG. 1.

Figure 5:
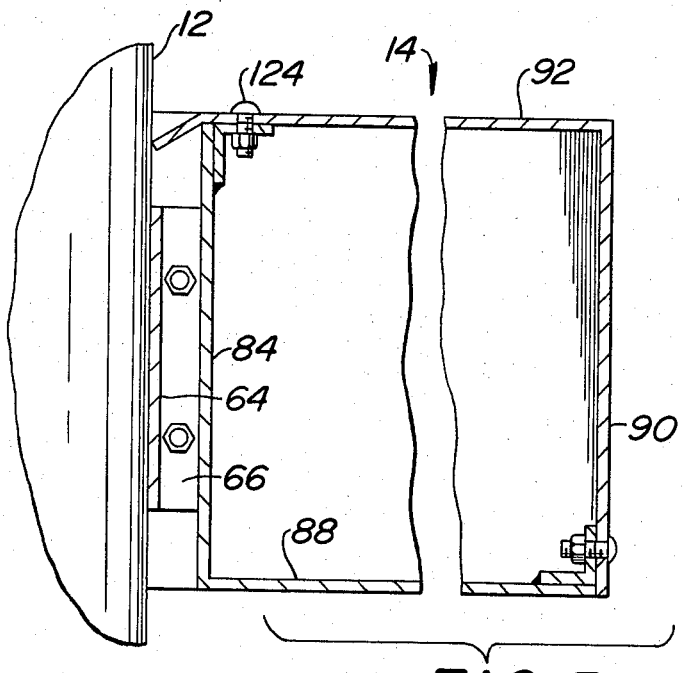
FIG. 5 is a sectional view taken along the line 5—5 in FIG. 1.

Referring to the drawings in detail, wherein like numerals indicate like elements, there is shown in FIG. 1 a lighting fixture in accordance with the present invention designated generally as 10 and removably attached to the outer periphery of a vertically disposed column 12. The column 12 may be solid or hollow and may be made from any one of a wide variety of conventional materials including metal, wood, concrete, brick, masonry, etc.

In FIG. 3, there is illustrated a mounting or securing means 18 for attaching the housing sections 14 and 16 to the outer periphery of column 12. The mounting means 18 includes mating angle plates 20 and 22 as well as mating angle plates 24 and 26. Plate 20 has a long leg 28 and a short leg 36. Leg 28 is provided with a hole 30. A hole 34 is provided on the long leg 32 of the plate 22. The holes 30 and 34 are aligned for a purpose to be made clear hereinafter.

Leg 36 on angle plate 20 is bolted to a flange 38 at one end of a clamp section 40. A flange 42 on the other end of the clamp section 40 is bolted to a flange 44 on one end of a clamp section 46. A flange 48 at the other end of clamp section 46 is bolted to the short leg 50 on the angle plate 24. The long leg 52 of angle plate 24 is provided with a hole 54.

The long leg 58 on angle plate 26 is provided with a hole 56. Hole 56 is aligned with hole 54 for a purpose to be made clear hereinafter. The short leg 60 of the angle plate 26 is bolted to a flange 62 at one end of a clamp section 64. A flange 66 at the other end of clamp section 64 is bolted to a flange 68 at one end of clamp section 70. A flange 72 at the other end of clamp section 70 is bolted to the short leg 74 of the angle plate 22.

The angle plates 20, 22, 24 and 26 are identical except that one plate of each matching pair has a spacer. Thus, the long leg 52 of angle plate 24 has a spacer 76 attached on its inner surface. A similar spacer 78 is attached to the long leg 28 of angle plate 20. Mating holes 35 are provided on the angle plates 20 and 22 so that they may be bolted together. Similar holes 59 are provided on the angle plates 24 and 26 so that they may be bolted together. The inner peripheral surface of the clamp sections 40, 46, 64 and 70 are a series of intersecting surfaces so that the clamp sections may be attached to vertical columns which are round, square, octagonal, etc. The mounting means 18 may be attached to columns of different diameters or transverse dimensions. Hence, the mounting means is universal since it may facilitate attachment of the fixture 10 to vertical columns of different transverse dimensions, different cross-sectional shapes, and may be attached to columns made from a variety of different materials. FIG. 3 illustrates the round or octagonal shaped column clamps 40, 46, 64 and 70. A different clamp shape is used on square or rectangular shaped columns.

The housing sections 14 and 16 are identical. Hence, only housing section 14 will be described in detail. For purposes of illustration, the housing section 14 is generally semi-circular. The fixture 10 may be rectangular, hexagonal, octagonal, etc. with each housing section being a segment of such shape. Each housing section has an inner periphery and an outer periphery. Referring to FIG. 2, the inner periphery of housing section 14 is defined by aligned walls 80 and 82 which are connected to the ends of arcuate wall 84. Arcuate wall 84 conforms to the shape of recess 86. Each of the walls 80, 82 and 84 is fixedly secured at their lower end to a horizontallly disposed bottom wall 88. See FIG, 5. It will be noted that the arcuate wall 84 provides clearance to the outer edge of the flanges 66, 68 on the mounting means 18. Also, it will be noted that the height of the mounting means 18 is less than the height of the housing section 14. See FIG. 5.

The outer periphery of the housing section 14 is defined by the curved wall 90. The upper edge of the outer wall 90 is integral with a top wall 92. At the inner periphery of the housing section 14, the top wall has a lip 94 which is inclined downwardly and inwardly. See FIG. 4. Below the lip 94 on each of the walls 80, 82, there is provided a clip 96 having a horizontal leg and a vertically disposed leg 98. The purpose of the clips 96 will be made clear hereinafter.

Within the housing section 14, and supported by the walls thereof, there is provided at least one source of light. In the preferred embodiment illustrated in the drawings, there is provided two such sources. The top wall 92 is provided with cut-out portions for removably securing in place a transparent portion such as a pane of glass. As shown in FIGS. 1 and 2, housing section 14 has a pair of panes of glass designated 100 and 102. Each pane of glass is associated with a light source arranged to project light upwardly through its associated pane of glass.

Figure 6:
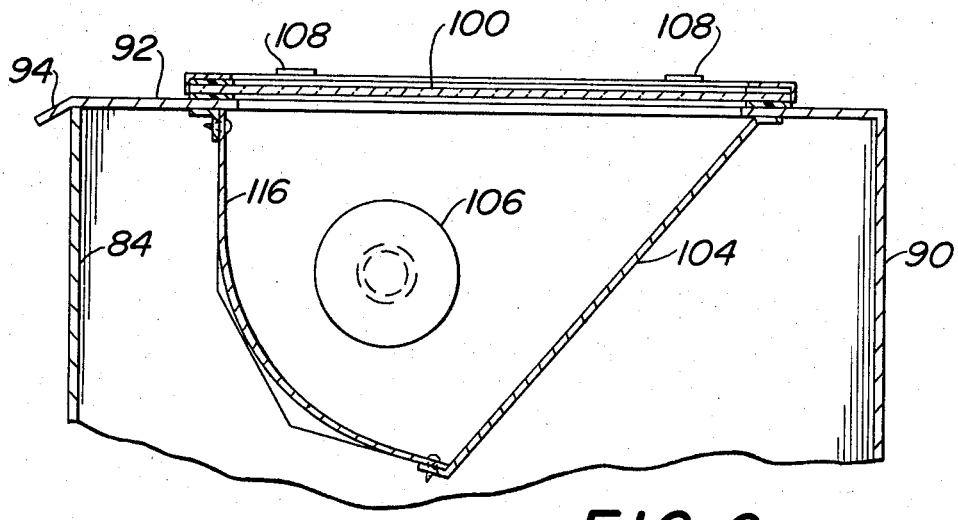
FIG. 6 is a sectional view taken along the line 6—6 in FIG. 1.

As shown more clearly in FIG. 6, the top wall 92 supports a casing 104 containing a source of illumination 106. The casing 104 is open at the top and is supported below the pane of glass 100. As shown more clearly in FIG. 7, the pane of glass 100 is removably located and retained in position by way of a plurality of clips 108. Each clip 108 overlies a rectangular metallic frame 110. Frame 110 overlies the top peripheral edge of the pane of glass 100 and extends around the periphery thereof. Glass pane 100 may be clear or frosted to various degrees to provide a sharp or diffuse lighting pattern. A seal or gasket 112 is provided between the bottom surface of the frame 110 and the top surface of glass pane 100 at the periphery thereof. A similar seal or gasket 114 is provided between the top surface of wall 92 and the bottom peripheral surface of the pane of glass 100. Access to the source of light 106 for relamping is attained by removing the clips 108 and then removing the pane of glass 100.

The inner surface of the casing 104 is a highly reflective surface. Preferably, the casing 104 includes a curved reflector portion 116 arranged to project the illumination upwardly through the pane of glass 100 at an angle not more than 60° with respect to the horizontal. As illustrated, the casings 104 are arranged to project the light in a direction away from column 12. If desired, the position of the casing may be reversed so as to project the light onto the outer peripheral surface of the column 12.

Each of the housing sections 14 and 16 is provided with ballast and other components of the circuitry associated with the sources of illumination. The housing sections 14 and 16 are preferably coupled together by threaded members 118 at a location between the inner and outer periphery of the housing sections. See FIGS. 2 and 4. The coupling members 118 are preferably provided with threads on their outer periphery for cooperation with a nut 120. Members 118 are preferably hollow so as to constitute a wireway between the housing sections.

Field installation of the fixture 10 may be attained as follows. The mounting means 18 is fixedly attached to the outer periphery of the column 12 at any desired locations such as 6 to 8 feet above ground level. In this connection, the column 12 may be of the type which supports a canopy with or without an advertising sign of the type commonly associated with business establishments such as gasoline stations, fast food stores, markets, etc. The column 12 may support any other type of structure which is desired to be illuminated by the fixture 10.

The mounting means 18 is securely attached to the column 12 by tightening the threaded fasteners on the flanges 42, 44, 66 and 68 as well as the threaded fasteners extending through the mating holes 35, 59. Thereafter, one of the housing sections such as section 16 is attained to the mounting means 18 by causing the vertical leg 98 on the clip 96 to extend downwardly between the long legs on the angle plates 20, 22, 24 and 26. At the same time, care was exercised so as to cause each of the coupling members 118 to project through one of the sets of mating holes (30, 34 or 54, 56) on the angle plates 20, 22, 24 and 26. At this point, the operator need no longer support the section 16 since it will be supported by the mounting means 18.

Thereafter, the operator may install the housing section 14 in a similar manner taking care that the vertical leg on the clip 96 enters the space between the long legs of the angle plates 20, 22, 24 and 26. At the same time, the operator will exercise care so that the coupling members 118 extend through the mating hole 122 on the walls 80, 82.

Thereafter, the threaded fasteners retaining the top wall 92 in position may be removed and the top wall together with its peripheral wall 90 may be slid in a direction radially outwardly for a sufficient distance so as to permit access of the operator's hands to attach the nut 120 and make electrical connections between conductors extending through the member 118 and the components associated with the sources of illumination. Thereafter, the top wall 92 is replaced in position and secured by way of the threaded fasteners 124.

The shape of the housing 10 is not limited to the circular shape illustrated. The ballast disposed within the housing sections are connected from a primary hub internally or externally of the column and are interconnected by way of the wireway provided by the hollow members 118.

The present invention may be embodied in other specific forms without departing from the spirit or essential attributes thereof and, accordingly, reference should be made to the appended claims, rather than to the foregoing specification, as indicating the scope of the invention.

I claim:

1. A lighting fixture adapted to be secured to a vertically disposed column intermediate the ends thereof comprising a housing divided into at least two sections, each housing section having an inner periphery and an outer periphery, the inner periphery on each housing section having a recess for receiving there within a portion of the periphery of a generally vertically disposed column or pole, each housing section having there within at least one source of illumination, each housing section having a top wall with a transparent portion through which illumination may be projected generally upwardly from its associated light source, each transparent portion being removably supported by said top wall to facilitate relamping of its associated light source without interfering with the mounting of the housing section on the column or pole, coupling means joining said sections together at juxtaposed walls on said section, said juxtaposed wall and said coupling means being disposed between the inner and outer peripheries of said sections, and means for securing said sections to a generally vertically disposed column or pole in a manner so that the inner periphery of the housing sections embrace the outer periphery of a column or pole, said securing means supporting said housing sections at a location between the inner and outer peripheries of said sections.

2. A lighting fixture in accordance with claim 1 including means defining a hollow wireway extending between the juxtaposed walls of said housing sections.

3. A lighting fixture in accordance with claim 1 wherein each leg of each clip means extends downwardly into the space between a pair of juxtaposed portions on said securing means.

4. The lighting fixture in accordance with claim 1 wherein the juxtaposed walls which are joined together by said coupling means are vertically disposed and fixedly connected to a bottom wall of its associated housing section, each housing section having a top wall fixedly secured to an outer peripheral wall of its associated section, whereby each housing section is defined by two sets of mating walls which are movable with respect to each other, each set of mating walls including a horizontally disposed wall and a vertical wall, and fastener means for removably securing the horizontal walls to an adjacent vertical wall of its set.

5. The lighting fixture in accordance with claim 1 wherein each housing section is provided with a clip means adjacent the upper end thereof, each clip means having a downwardly extending leg to facilitate support of the associated housing section on said securing means before said housing sections are coupled together by said coupling means.

6. The lighting fixture in accordance with claim 1 wherein said securing means includes two sets of parallel spaced apart plates which support said housing sections, each of the plates being vertically disposed, the sets being approximately 180° apart and extending outwardly away from a centrally disposed clamp means.

7. The lighting fixture in accordance with claim 6 wherein said clamp means includes a plurality of clamp sections bolted together, each clamp section having an inner peripheral surface contoured to facilitate clamping to circular and non-circular surfaces of a generally vertically disposed column.

8. The lighting fixture in accordance with claim 6 wherein the plates of each set have aligned holes, said coupling means joining said sections together including a discrete fastener extending through each of the aligned holes in said sets of plates.

9. The lighting fixture in accordance with claim 1 wherein said housing is annular, each housing section having a plurality of sources of illumination, the sources of illumination on said housing being equally spaced.

10. The lighting fixture in accordance with claim 1 wherein said sources of illumination are arranged for directing illumination upwardly and outwardly away from the axis of said recesses.

11. A lighting fixture comprising a housing divided into at least two sections, each housing section having an inner periphery and an outer periphery, the outer periphery on each housing section having a recess for receiving therein a portion of the periphery of a generally vertically disposed column, each housing section having therewithin at least one source of illumination, each housing section having a horizontally disposed wall with a transparent portion through which illumination may be projected from its associated source of illumination, coupling means joining said sections together, means for securing said sections to a column in a manner so that the inner periphery of the housing sections embrace the outer periphery of a column, said securing means including a plurality of components bolted together for clamping to the outer periphery of a column, means on each section at a location between the inner and outer peripheries of each section for coupling each section to said securing means so that said securing means supports each housing section.

12. A lighting fixture in accordance with claim 11 wherein each housing section is comprised of two housing portions, each housing portion having a horizontally disposed wall connected to a vertically disposed wall, and fastener means removably securing each horizontal wall to an associated vertical wall of its housing portion.

13. A lighting fixture in accordance with claim 11 wherein said coupling means includes a member extending through said securing means.

14. A lighting fixture in accordance with claim 13 wherein said coupling means is hollow so that it may be used as a wireway.

* * * * *